US005650618A

United States Patent [19]

Tuszewski

[11] Patent Number: 5,650,618

[45] Date of Patent: Jul. 22, 1997

[54] COMPACT MASS SPECTROMETER FOR PLASMA DISCHARGE ION ANALYSIS

[75] Inventor: Michel G. Tuszewski, Los Alamos, N. Mex.

[73] Assignee: The Regents of the University of California, Los Alamos, N. Mex.

[21] Appl. No.: 568,899

[22] Filed: Nov. 30, 1995

[51] Int. Cl.[6] ..... H01J 49/40

[52] U.S. Cl. ..... 250/296; 250/294; 250/281; 250/282

[58] Field of Search ..... 250/296, 295, 250/294, 281, 282, 283, 286, 397, 297, 298, 299

[56] References Cited

U.S. PATENT DOCUMENTS

| | | | |
|---|---|---|---|
| 4,611,118 | 9/1986 | Managadze | 250/287 |
| 5,453,614 | 9/1995 | La Fontaine et al. | 250/296 |

OTHER PUBLICATIONS

"Composition of the oxygen plasmas from two inductively couple sources", J. Vac. Sci. Technol. A 13(3), May/Jun. 1995, 839–842, M. Tuszewski et al., Los Alamos National Laboratory, Los Alamos, New Mexico.

"Measurement of ion species ratio in the plasma source ion implantation process", J. Appl. Phys. 73(9), 1 May 1993, 4176–4180, B. Y. Tang et al.

"Mass Spectrometric Studies of Positive Ions in R.F. Glow Discharges", Thin Solid Films, 171 (1989) 65–80, J.W. Coburn.

"An omegatron mass spectromete for plasma ion species analysis", Rev. Sci. Instrum. 61 (8), Aug. 1990, 2155–2158, E. Y. Wang et al.

*Primary Examiner*—Jack I. Berman
*Assistant Examiner*—Kiet T. Nguyen
*Attorney, Agent, or Firm*—Richard J. Cordovano; Samuel M. Freund

[57] ABSTRACT

A mass spectrometer and methods for mass spectrometry which are useful in characterizing a plasma. This mass spectrometer for determining type and quantity of ions present in a plasma is simple, compact, and inexpensive. It accomplishes mass analysis in a single step, rather than the usual two-step process comprised of ion extraction followed by mass filtering. Ions are captured by a measuring element placed in a plasma and accelerated by a known applied voltage. Captured ions are bent into near-circular orbits by a magnetic field such that they strike a collector, producing an electric current. Ion orbits vary with applied voltage and proton mass ratio of the ions, so that ion species may be identified. Current flow provides an indication of quantity of ions striking the collector.

18 Claims, 6 Drawing Sheets

COMPACT MASS SPECTROMETER FOR PLASMA DISCHARGE ION ANALYSIS

FIELD OF THE INVENTION

This invention relates to the field of chemical analysis and, more particularly, to determination of mass and quantities of ions existing in a plasma by means of mass spectrometry. This invention was made with government support under Contract No. W-7405-ENG-36 awarded by the U.S. Department of Energy. The government has certain rights in the invention.

BACKGROUND OF THE INVENTION

Knowledge of ion species and their concentrations in plasmas is necessary to the conduct of research and to improve manufacturing processes which utilize plasmas. The mass spectrometers currently used for this purpose are complex, expensive, and usually too large to properly characterize a plasma. These spectrometers can be used only for edge studies, in which measurements are made at the edges of a plasma rather than at locations where articles are placed for processing. Edge spectroscopy and theoretical modeling provide useful qualitative information on plasma composition, but normally do not provide quantitative information. The present invention provides an inexpensive and less complex mass spectrometer which is sufficiently small that it is capable of use in characterizing the entire volume of a plasma without perturbing it, that is, without significantly changing the characteristics of a plasma by use of the spectrometer. It is capable of use for performing in-situ mass spectroscopy of plasmas. Quadrupole mass spectrometers are widely used for characterization of plasmas at their edges. The cost of a quadrupole mass spectrometer and necessary accessories suitable for such use is in the range of $30,000 to $100,000.00. An instrument of the present invention can be fabricated and the required power supply and signal processing apparatus purchased for less than $1,000.00 (the cost will increase with increased sophistication of the electronics).

A plasma is comprised of atoms and molecules in a gaseous state having no electrical charge, ions formed from the gas by providing energy to the gas, and electrons. The un-ionized atoms and molecules are termed neutrals. The ions are normally positive, but attachment of electrons to neutrals can take place so that negative ions are present in the plasma. A plasma may be produced in a chamber maintained at low pressure (normally, at pressures in the vacuum range) by introducing a gas into the chamber and providing energy to the gas by such means as an arc discharge or radio-frequency induction fields.

Plasma processing is currently used primarily in manufacture of microelectronics components and is expected to be used more extensively in the future. Wet chemical processes are used to etch (remove material from) surfaces of wafers which are an intermediate product in the manufacture of integrated circuit devices, or chips. Waste products from such wet chemical processing are hazardous and expensive to reclaim. Plasma processing may be substituted for wet chemical processing. An oxygen plasma may be used for removal of photoresist mask material from microelectronics components after the process requiring masking is accomplished. Cleaning of surfaces may be done by plasma processing. For example, cutting fluids, oils, and greases may be removed from machined parts by means of an oxygen plasma, thus avoiding use of solvents. When a part is exposed to the plasma, oxygen ions strike the surface of the part, breaking chemical bonds between atoms of the hydrocarbons and creating reactive sites. Also, the plasma provides energy to the near-surface region which assists desorption of contaminants and enhances the chemical reactions. The products of this cleaning process are carbon dioxide and water vapor. Plasma processing is used to deposit material on a surface. For example, a mirror may be coated with a reflecting layer of gold or aluminum. Glass may be coated with a material which prevents ultraviolet light from passing through the glass. An oxygen plasma may be used to produce a thin layer of silicon oxide on a silicon surface. Diamond-coated objects may be produced by subjecting the object to carbon ions produced in a plasma. implantation of ions in a surface to modify its properties may be accomplished by plasma processing. For example, surfaces may be hardened by implanting nitrogen ions (nitriding) or boron atoms (boriding). The mass spectrometer of this invention provides means to monitor such processes in a production facility and to study such processes.

SUMMARY OF THE INVENTION

This invention is a mass spectrometer and methods for mass spectrometry which are useful in characterizing a plasma. This mass spectrometer for determining type and quantity of ions present in a plasma is simple, compact, and inexpensive. It accomplishes mass analysis in a single step, rather than the usual two-step process comprised of ion extraction followed by mass filtering. Ions are captured by a measuring element placed in a plasma and accelerated by a known applied voltage. Captured ions are bent into near-circular orbits by a magnetic field such that they strike a collector, producing an electric current. Ion orbits vary with applied voltage and proton mass ratio of the ions so that ion species may be identified. Current flow provides an indication of quantity of ions striking the collector.

It is an object of this invention to provide an apparatus and method for determining the quantity and mass of ions produced in a plasma containing a single species or multiple species of ions.

It is also an object of this invention to provide a mass spectrometer which is sufficiently small that it can be introduced at any desired location in a plasma for use in completely characterizing a plasma without significantly perturbing it.

Another object of the invention is to provide an inexpensive mass spectrometer useful in characterizing a plasma.

In one embodiment, the invention includes a mass spectrometer comprising in combination a shield enclosure of an electrically conductive material; a measuring enclosure of a magnetic material which is located inside the shield enclosure and is spaced apart from the shield enclosure by electrically insulating material; an aperture in the shield enclosure and a foil which covers the shield aperture, where the shield foil has an ion pathway; an entrance aperture in the measuring enclosure and an entrance foil which covers the entrance aperture, where the entrance foil has an ion pathway, and where the shield ion pathway and said entrance ion pathway are in register with one another; an exit aperture in the measuring enclosure and an exit foil which covers the exit aperture, where the exit foil has an ion pathway, and where the exit aperture and the exit foil are disposed such that the axial centerline of the exit ion pathway and the axial centerline of the entrance ion pathway are located in a single plane; one or more permanent magnets disposed inside the measuring enclosure to form a magnetic field, where magnetic lines of force of the magnetic field are normal to the plane of the ion pathways; a collector which is disposed adjacent to the exit foil in such manner that ions passing out of the measuring enclosure through the exit ion pathway will strike said collector; an electrical path from the collector to a reference location; means for establishing a known applied electrical potential between the measuring enclosure and the reference location, where said applied potential has a value effective for determination of proton mass ratio of the ions which strike the collector; and means for measuring electric current flowing along said electrical path, where said the electric current results from the ions striking the collector.

In another embodiment, the invention is a method for determining mass and quantities of ions comprising the steps of maintaining a shield enclosure at an electrical potential relative to a reference location, where the electrical potential is termed the floating potential and is established by means of placing the shield enclosure in plasma, where the shield enclosure has an ion pathway, and where the difference in magnitude between plasma potential and said floating potential induces ions to enter the shield enclosure through said shield ion pathway and accelerates the entering ions; providing a measuring enclosure having an entrance ion pathway, where the measuring enclosure is located inside the shield enclosure and is spaced apart from the shield enclosure by electrically insulating material, and where the entrance ion pathway is in register with the shield ion pathway; establishing a known electrical potential, termed the applied potential, between the measuring enclosure and the reference location, where the applied potential induces ions passing through the shield ion pathway to enter the measuring enclosure through the entrance ion pathway and accelerates the entering ions; providing a magnetic field in the measuring enclosure having magnetic lines of force which are normal to the paths of the ions entering the measuring enclosure, where the magnetic field causes the ions which enter the measuring enclosure to travel in a non-linear orbit; providing an exit ion pathway in the measuring enclosure, where the axial centerline of the exit ion pathway and the axial centerline of the entrance ion pathway are in a single plane, and where the exit ion pathway is located such that a portion of the ions entering the measuring enclosure will pass through the exit ion pathway; providing a collector disposed outside the measuring enclosure in such manner that the ions passing through the exit ion pathway will strike said collector; providing an electrical path from the collector to the reference location; measuring electric current flow in said electrical path, where said electric current results from the ions striking the collector; and determining the proton mass ratio of ions striking the collector by reference to the values of the applied potential and the plasma potential.

BRIEF DESCRIPTION OF THE DRAWINGS

FIG. 2 also contains a schematic representation of means for providing electrical potential, means for pumping on the measuring element, and means for measuring electrical current.

DETAILED DESCRIPTION OF THE INVENTION

Figure 1:
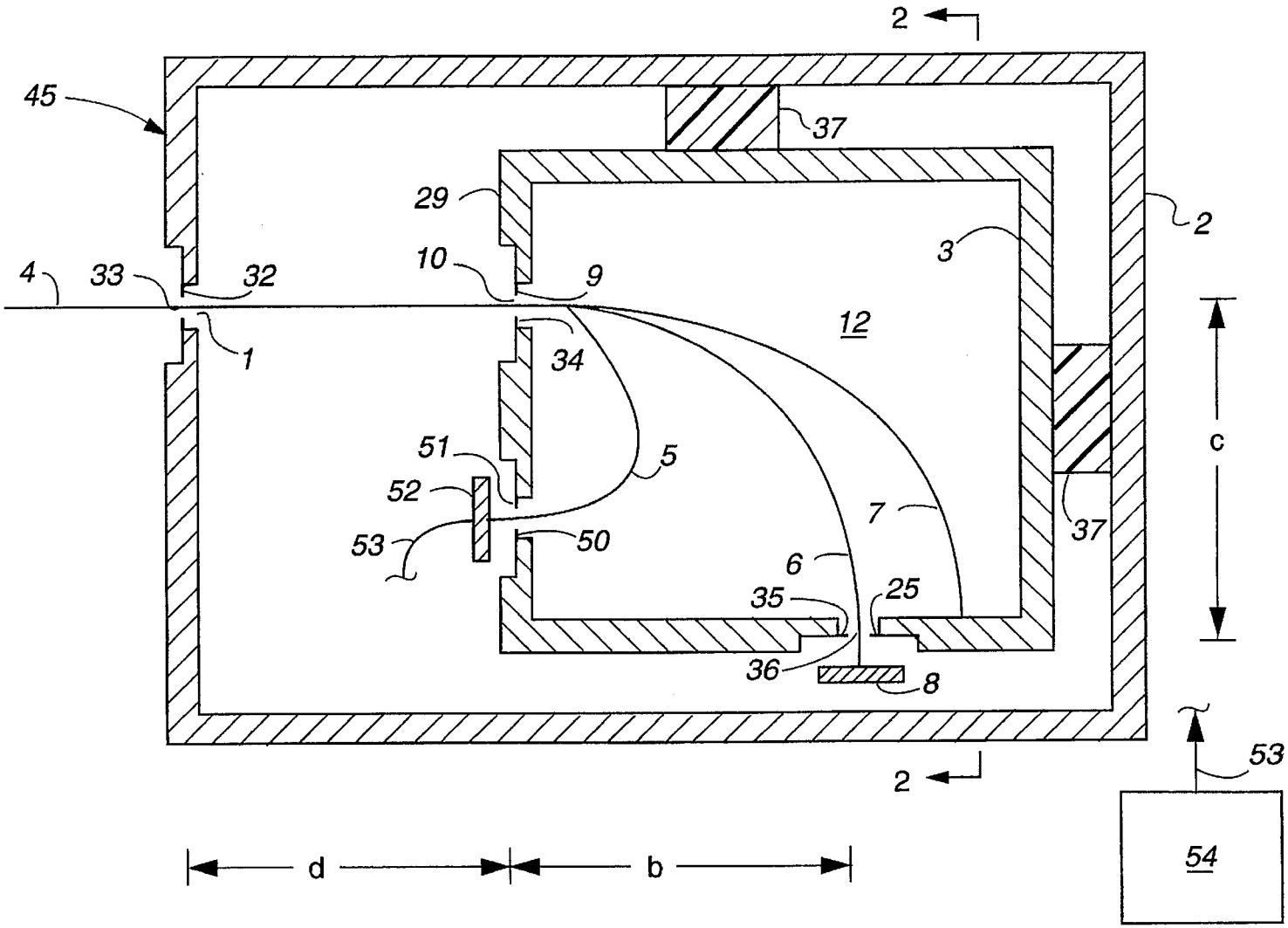
FIG. 1 is a sectional elevation depicting a measuring element and ion paths.
Figure 2:
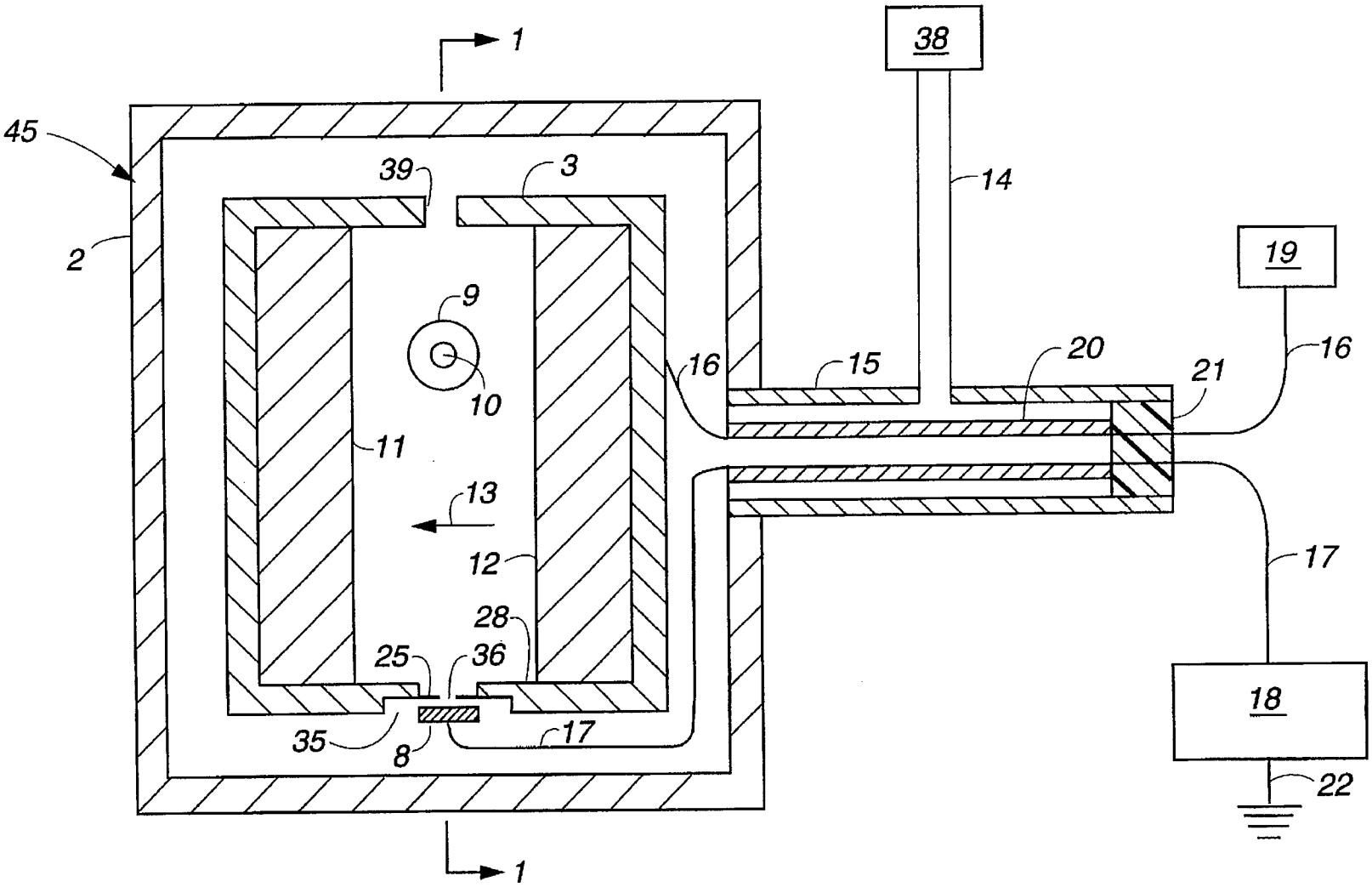
FIG. 2 is a sectional elevation of the measuring element of FIG. 1, taken as shown by the section arrows of FIG. 1. The section arrows of FIG. 2 show the relationship of FIGS. 1 and 2. The section planes of FIGS. 1 and 2 are 90 degrees apart.

Following is a description of a prototype mass spectrometer and an exemplary embodiment of the invention which is depicted in FIGS. 1 and 2. Measuring element 45 is comprised of measuring enclosure 3 and shield enclosure 2. The measuring element is placed in a plasma. The measuring enclosure is located within the shield enclosure. Shield enclosure aperture entrance foil 32, or shield foil 32, covers shield enclosure aperture 1. Measuring enclosure aperture entrance foil 9, or entrance foil 9, covers measuring enclosure entrance aperture 34. Reference number 4 depicts the paths of ions passing into the shield enclosure through a hole in shield foil 32, that is, along shield ion pathway 33, and then into the measuring enclosure through a hole in entrance foil 9, that is, along entrance ion pathway 10. Ion pathways 10 and 33 are in register with one another, that is, the axial centerlines of the two ion pathways are on a single line. Reference numbers 5, 6, and 7 show paths which ions may take after they enter the measuring enclosure; the path which an ion follows depends on its energy. The two enclosures are spaced apart from one another by electrically insulating material, as depicted by exemplary spacer blocks 37.

Ions which enter the measuring enclosure assume non-linear orbits which are near circular because they are acted upon by a near-constant magnetic field produced by permanent magnets 11 and 12. Arrow 13 shows the direction of the magnetic lines of force of the magnetic field which is normal, or perpendicular, to a plane which contains the axial centerlines of entrance ion pathway 10 and exit ion pathway 36. Ions traveling along ion path 6 pass through exit ion pathway 36 in exit foil 25, which covers exit aperture 35. These ions then strike collector 8 which is connected to a reference location at a constant electrical potential by means of an electrical path represented by wires 17 and 22. The reference location is normally the chamber in which the plasma producing the ions is located, referred to as the chamber ground. The chamber is usually grounded to the earth. Reference number 18 shows means for measuring and recording electric current flowing in wires 17 and 22 which results from ions striking collector 8.

Reference number 19 depicts means for applying, recording and varying an electrical potential between measuring enclosure 3 and the reference location. Wire 16 connects this power supply means to the enclosure. Wires 16 and 17 pass through shield 20, which is located inside of stem 15. Stem 15 is an elongated hollow rod of an electrically insulating material which is suitable for service in the vicinity of a plasma, such as a ceramic. Shield 20 is a hollow rod of an electrically conductive material which surrounds wires 16 and 17. Plug 21 provides a vacuum seal at one end of stem 15 through which the wires pass. Stem 15 is connected to shield enclosure 2. Conduit 14 communicates with the interior of the shield enclosure via stem 15 and with vacuum pump 38 which is capable of reducing the pressure inside of the shield enclosure. Aperture 39 is provided in measuring enclosure 3 to ensure that a path exists for removal of gas from the measuring enclosure.

Figure 3:
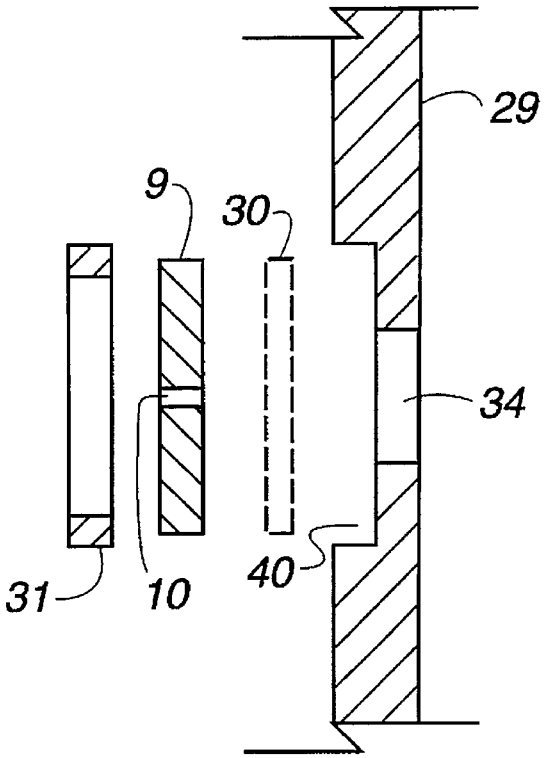
FIG. 3 is an exploded detail of an entrance aperture and associated apparatus.

FIG. 3 depicts apparatus for providing an ion pathway into the measuring enclosure. This exploded drawing is a detail of FIG. 1. A similar arrangement may be used for the shield ion pathway and there are other ways known to those skilled in the art to provide an ion pathway effective in the practice of this invention. The wall of the measuring enclosure, denoted by reference number 29, contains aperture 34. Entrance foil 9, having ion pathway 10, rests in recess 40 of wall 29. Washer 31 is placed in recess 40, with an interference fit, in order to hold foil 9 in place. Wire mesh 30 is sandwiched between the foil and the wall of the enclosure. The purpose of the wire mesh is to prevent voltage shielding by the plasma. The mesh used in the exemplary apparatus is of copper with square openings of 64 μm and 95% transparency. It is desirable that the size of the mesh be about equal to or smaller than typical plasma Debye lengths.

Figure 4:
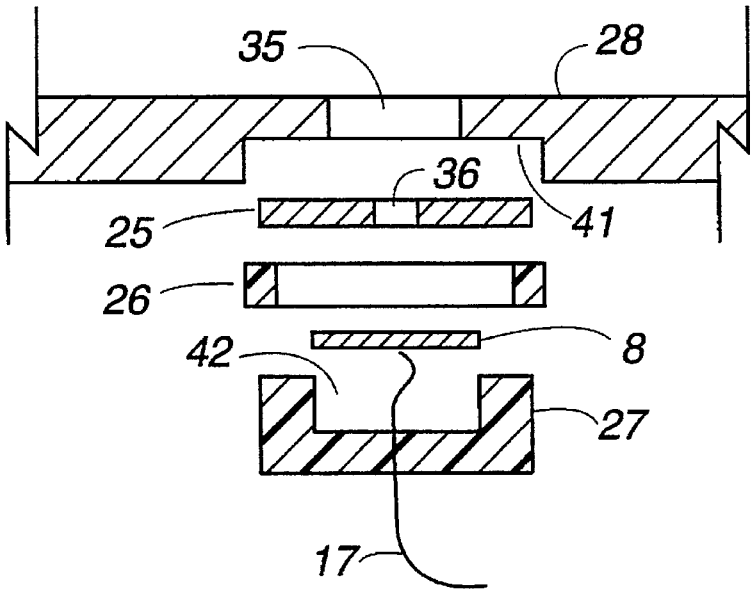
FIG. 4 is an exploded detail of the exit aperture and associated apparatus, including a collector.

FIG. 4 depicts apparatus for providing an ion pathway to the collector. Other arrangements may be used. Exit foil 25 rests in recess 41 of measuring enclosure wall 28, covering aperture 35. Exit foil 25 has exit ion pathway 36 and is retained in recess 41 by washer 26. Collector 8 is a disk of copper which rests, in an interference fit, in recess 42 of retainer 27. Retainer 27 is of an electrically insulating material and rests inside of washer 26 in an interference fit. Wire 17 passes out of the enclosure to current measuring means 18.

The measuring element is placed in a plasma. Ions of the plasma pass into the measuring enclosure by means of the ion pathways in the shield foil and the entrance foil. The difference in magnitude between plasma potential, $V_p$, and floating potential, $V_f$, induces ions to enter the shield enclosure, and some ions enter simply because their paths happen to coincide with the shield ion pathway. The ions are accelerated from the electrical potential of the plasma, $V_p$, to the floating potential. Floating potential is the electrical potential, relative to the reference location, which is assumed by the shield enclosure as a result of its presence in the plasma. Ions which enter the shield enclosure are induced to enter the measuring enclosure and are further accelerated by $V_a$, the electrical potential applied between the measuring enclosure, and the reference location. Ions are acted upon by the magnetic field created by the permanent magnets in the measuring enclosure and their paths, or orbits, are bent into a near circular configuration. Orbit radius refers to the path which an ion follows after entering the measuring enclosure. Ion paths 5, 6, and 7 of FIG. 1 are examples of different orbit radii. Ion mass and quantities may be determined as follows.

Energy possessed by an ion, E (in volts), is $$E=V_pV_a.$$

Orbit radius, ρ, of an entering ion, in mm, can be calculated by the equation $$\rho=0.144\ (EA/Z)^{0.5}/B.$$

Transforming the equation:

$$A/Z=48.2253\ B^2\rho^2/E.$$

B is the average magnetic field strength in Tesla at the location of the ion path. Z is the charge state of the ion. A is the proton mass ratio of the ion, which is ion mass divided by mass of a proton.

$\rho_s$ is the orbit radius of an ion entering the measuring enclosure which passes through the exit foil and strikes the collector. $\rho_s$ is established by the dimensions of the measuring enclosure. At a single value of $V_a$, only ions of a single proton mass ratio will strike the collector. Ions having other mass ratios will assume orbits having radii less than $\rho_s$, as shown by ion path 5 of FIG. 1, or greater than $\rho_s$, as shown by ion path 7. Determination of proton mass ratio of ions striking the collector by means of the above equations serves to identify the species of the ions. Those skilled in the art normally deal with the quantity A/Z. Ions striking the collector cause an electric current, termed ion current, to flow in an electrical path between the collector and the reference location. Ion current provides an indication that ions are striking the collector. When ion current is zero, no ions are striking the collector. $V_a$ may be varied while ion current flow is simultaneously measured. This is termed a voltage scan or sweep. A plot of applied voltage versus ion current may be used to identify values of $V_a$ for use in calculating A/Z and A. The proton mass ratio is calculated for peak values of ion current and provides the atomic weight of ions which strike the collector at those points, or peaks, on a voltage scan plot.

Figure 5:
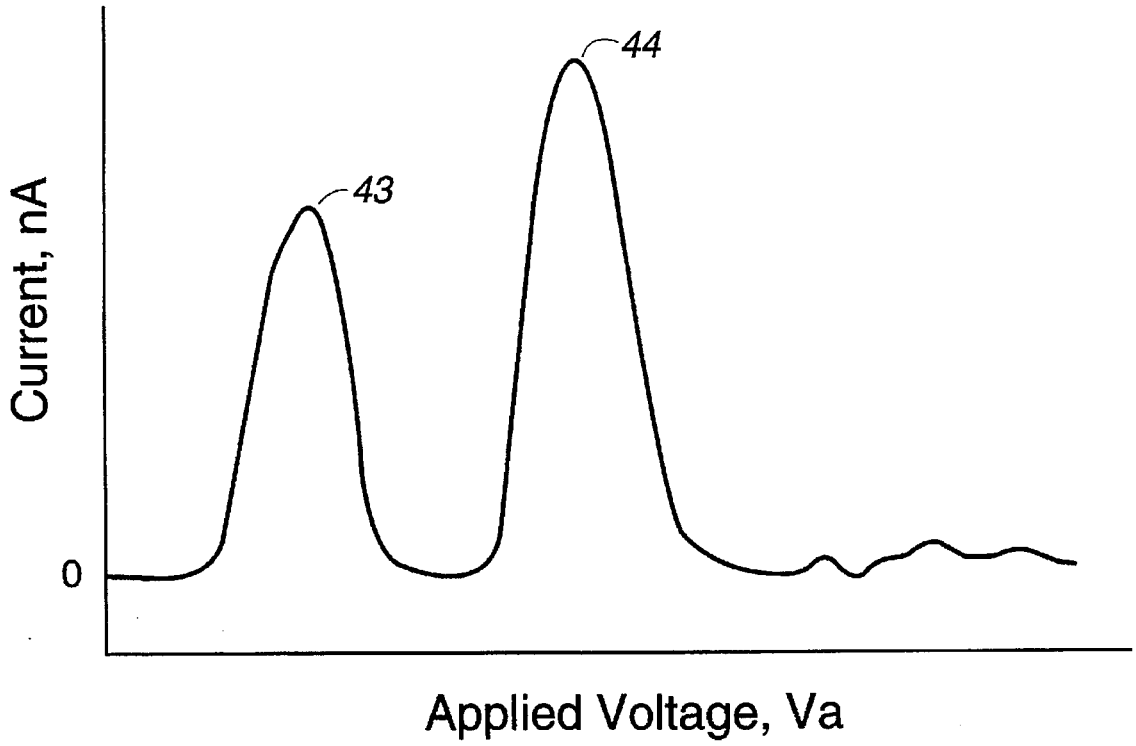
FIG. 5 is a simulated plot obtained in the practice of the invention.

FIG. 5 is a simulated plot of ion current flow versus $V_a$ obtained when a voltage scan was done with a measuring element placed in a pure oxygen plasma formed in a vacuum chamber maintained at about 1.0 mTorr, where the plasma was formed by energy supplied by an induction coil operated at 500 W. The peak indicated by reference number 43 is at about minus 42 V, and the peak indicated by reference number 44 is at about minus 13 V. Using the above equations, A for peak 43 is 16 and A for peak 44 is 32, indicating that the first peak is due to $O^+$ ions striking the collector and the second peak is due to $O_2^+$ ions striking the collector, since the molecular weight of oxygen is 16 and that of an $O_2$ molecule is 32. The valleys at a current flow of zero on the X axis indicate that no ions were striking the collector at the corresponding applied voltage values. In a plasma containing other ions, peaks would occur at other voltages and calculation of proton mass ratios for those voltages would indicate the species of ion present. Peak heights indicate the relative amounts of ions present. In FIG. 5, peak heights were 1.35 nA and 1.52 nA, showing that $O_2^+$ was the more populous species and that the ratio of $O_2^+$ to $O^+$ is 1.13. Calibration of a system may be accomplished by feeding gases into a plasma chamber one at a time. Investigators are normally interested in relative quantities of ion species rather than absolute numbers of ions, though absolute quantities may be calculated by those skilled in the art.

The outside dimensions of the shield enclosure of the prototype instrument are 58 mm×47 mm×38 mm high. The outside dimensions of the measuring enclosure are 36 mm×28 mm×25 mm high. $\rho_s$ is 16 mm and the linear distance between the shield foil and the entrance foil is 11 mm. A pumped measuring element having outside dimensions of 40×32×32 mm and $d=\rho_s=16$ mm has been designed. Referring to FIG. 1, $\rho_s$=b=c and d=11 mm. The shield enclosure shields the measuring enclosure from the plasma and serves to prevent a large extracted current flow. The prototype shield enclosure is of aluminum; however it may be comprised of any conductive material suitable for exposure to the operational environment. The shield enclosure is present because, if it were not, electron current would collect on the measuring enclosure when applied potential is greater than plasma potential. This would perturb the plasma and cause a large current flow in the wire to the power supply, probably causing the current flowing from the power supply to be greater than its rating. A shield enclosure may be of a non-conductive material, such as quartz, with a metal lining. The prototype measuring enclosure is of steel; any magnetic material may be used. Teflon (registered trademark) was used for spacer blocks to provide electrical separation between the two enclosures and for the collector retainer since it has good high temperature and vacuum properties, remaining dimensionally stable and not outgassing while in the vicinity of a plasma; other insulating materials, such as a machinable ceramic, may be used. The shield foil, entrance foil, and exit foil of the prototype measuring element are of 50 μm thick stainless steel. The shield ion pathway, entrance ion pathway, and exit ion pathway were drilled through the foils using a 1/32 in. drill. The foils may be of any conductive material.

The permanent magnets of the prototype instrument are samarium/cobalt and provide an average magnetic field strength of about 0.28 T. Other types of magnets which provide magnetic fields of appropriate strengths to match the parameters of the above equation may be used in determining proton mass ratio. Location and quantities of magnets may be varied as long as magnetic field direction is as specified herein. The collector of the prototype instrument was a copper disc of 6 mm diameter and 1.6 mm thick having a wire soldered to it. The collector may be of any convenient size such that ions leaving the measuring enclosure will strike it. It may be of any conductive material which is resistant to ion impact and which will provide low secondary electron emissions. In applications where ion impacts might cause spallation of the collector surface, a more resistant material than copper, such as tungsten or molybdenum, may be used. It is preferable to use wire mesh (to prevent voltage shielding) of tungsten rather than copper in order to avoid, when plasma ions strike the mesh, creation of copper ions and a small peak attributable to copper. The plug, or seal, at one end of the stem may be of any suitable material. The washers for retaining the foils may be of any convenient material which is resistant to conditions near the plasma being studied. Aluminum and Teflon were used in the prototype.

The axial centerlines of the ion pathways in the foils should be normal to the foils. It is desirable that the foils be thin so that ions having paths which are not parallel to the axial centerlines are less likely to strike the foil as they pass through, that is, so that clipping is avoided. It is desirable that the ions passing through the exit foil travel along paths normal to the foil, that is describe an arc of 90° between the entrance foil and the exit foil. Referring to FIG. 1, this may be achieved by setting the c dimension equal to the b dimension. Providing a measuring enclosure with b equal to c reduces the possibility that ions passing through the exit foil will strike the edge of the foil before they leave the ion pathway. In order to achieve good mass resolution, it is highly desirable that the d dimension be about equal to the b dimension and that the d dimension be as large as possible without causing the measuring element to be so large as to significantly perturb the plasma. To achieve this, the d dimension will be about 100 to 200 plasma Debye lengths. Also, resolution improves with decreasing ion pathway diameter. Resolution is also affected by orbit radius, ion pathway alignment, ion-neutral collisions, plasma potential fluctuations, and plasma temperature. High resolution provides a spike rather than a broad peak, that is, the voltage range over which an ion current relating to a particular ion species is seen is small.

In experimentation conducted with the prototype instrument, $V_p$ was in the range of 10 to 20 V and $V_f$ was in the range of 0 to 4 V. These are the ranges normally seen in experimentation. The applied potential may be provided with a direct current power supply and varied manually in steps. In the first experiments, steps of 2 to 5 V were used and ion currents were measured with a Fluke Model 77 multimeter, using the $10^7$ Ω resistor of the meter. Typical ion currents were 1 to 10 nA. In later experimentation, voltage scans from plus 100 V to minus 100 V were accomplished with circuitry similar to that used for Langmuir probes. Data was taken with a personal computer-based Langmuir probe data acquisition system, where a plus or minus 5 V range is amplified to plus or minus 50 V and a 100 V voltage sweep is obtained with an additional fixed series voltage. Slow sweeps of 15 seconds duration over the 200 V range (250 samples with 60 ms/sample and 0.4 V increments) were used to avoid lead capacitance effects. The collected ion currents were measured with a $10^8$ Ω resistor connected to the data acquisition system via an operational amplifier (Tektronix AM 501). Typically, 3 to 5 successive sweeps were done and then averaged in order to improve the signal to noise ratio. The data were very repeatable.

Figure 6:
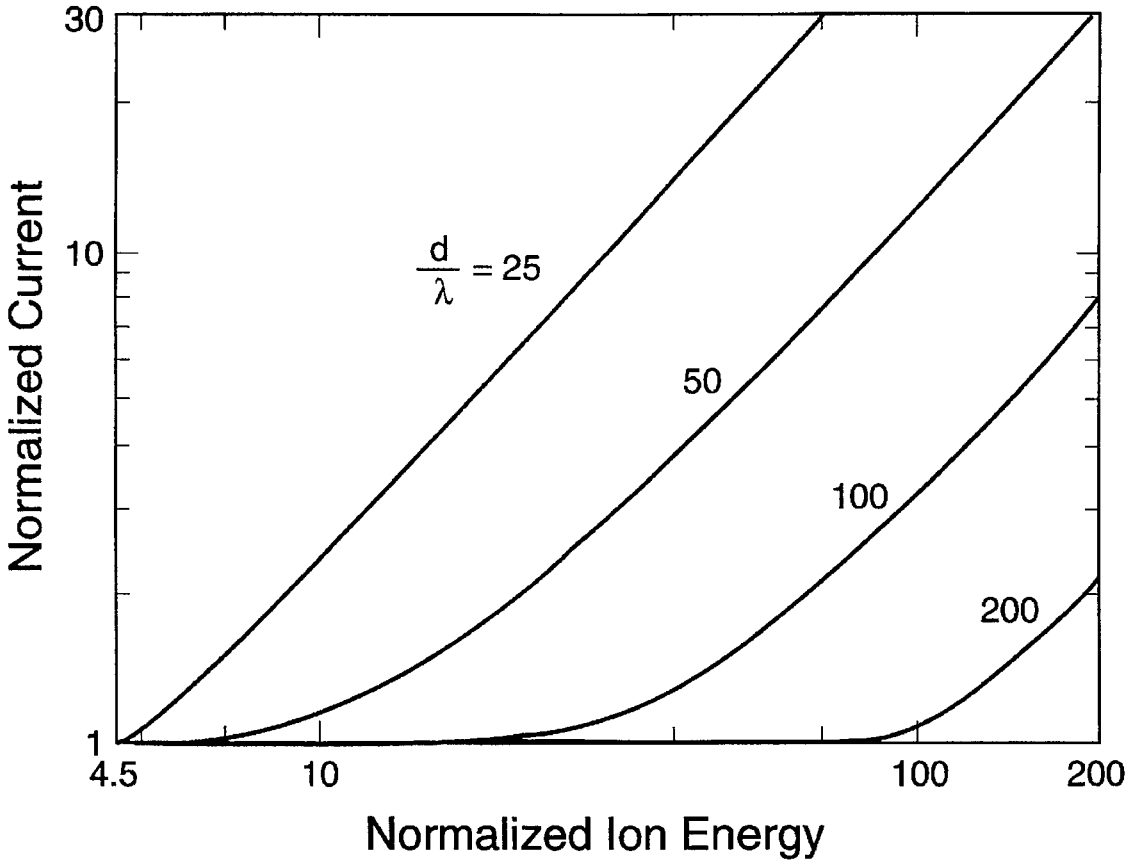
FIG. 6 is a plot which shows that extracted current can be maintained at a constant value while practicing this invention.

Use of a variable extraction voltage and a fixed magnetic field has a potential danger of introducing variations in extracted current. Extracted current is ion current (current due to ions striking the collector) plus current due to ions which strike the measuring enclosure at locations on its inner surface. Varying extracted current will cause variations in peak heights, causing ratios of ion species quantities to be inaccurate. However, both theoretical analysis and experimental data show that a constant extracted current can be maintained, provided that dimension d of FIG. 1 is at least about 100 to 200 plasma Debye lengths; this can be seen from FIG. 6. FIG. 6 presents calculated normalized ion currents as a function of normalized ion energy for four different ratios of aperture separation, d, to bulk plasma Debye length, λ. Normalized current equals extracted current divided by plasma current. Plasma current=$en_oV_o$, where e=electron charge, $n_o$=bulk plasma density, and $V_o$=$(2eT_e/m)^{0.5}$, where $T_e$=electron temperature and m=ion mass. Normalized ion energy is $E/T_e$. As d is increased, normalized ion current remains flat at a value of one for larger ranges of normalized ion energy. Thus, establishing d at an appropriate value removes the danger of introducing variations in extracted current. Also, accuracy is assured by limiting $V_a$ to a range of from −100 V to +100 V. Experiments to demonstrate that extracted current remains sufficiently constant within the 200 V range of applied voltage were conducted. A collector was placed inside the measuring enclosure in a location close to the entrance ion pathway such that substantially all ions entering the measuring enclosure struck the collector. Data was gathered using an oxygen plasma formed by a 400 W inductive source at 1 mTorr. Before this invention, it was not known by those skilled in the art that constant extracted current was obtainable in the manner of the invention.

The shield enclosure and measuring enclosure may be pumped, that is; a vacuum pump may be connected to the stem or shield enclosure to remove gas from the measuring element in order to reduce ion scattering. It is desirable that the mean free path, that is, the average length of a path followed by a particular ion between collisions by the ion with neutrals, be larger than the length of the ion path from entrance foil to exit foil. Pumping is not required if neutral pressure is less than about 2 to 3 mTorr, since ion/neutral mean free paths are about 50 mm at 1 mTorr. Pumping can be accomplished by connecting the conduit of FIG. 2 to a channel through the shield enclosure, though it may not be desirable to locate the conduit such that it may perturb the plasma. The stem may be utilized as a handle, in that the measuring element may be moved across a plasma chamber by inserting or withdrawing the stem. In this case, the stem passes out of the chamber through a port having a sealing mechanism around the stem. The measuring enclosure and shield enclosure shown in FIGS. 1 and 2 are of rectangular geometry. However, the enclosures may be of any convenient geometry. This invention can be used in characterizing plasmas having densities in the range of about $10^{15}$ to $10^{18}$ $m^{-3}$ and electron temperatures of a few eV.

Figure 7:
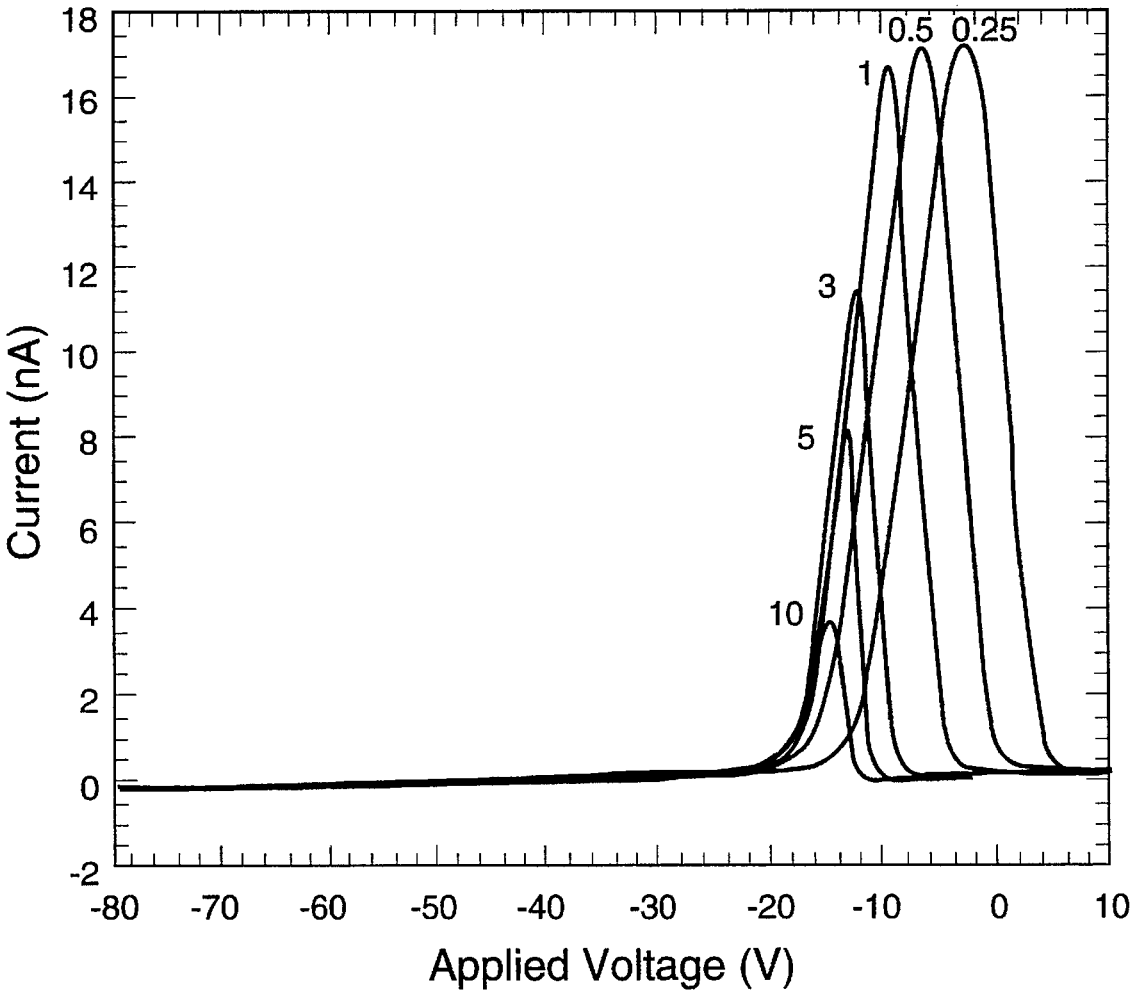
FIG. 7 shows changes in the peak location for an argon plasma with different measuring enclosure pressures.

FIG. 7 shows data from experimentation with an argon plasma. Six different $Ar^+$ (A=40) peaks are shown for 6 different pressures in the measuring enclosure established by pumping. The pressures are 0.25, 0.5, 1, 3, 5, and 10 mTorr. The $Ar^+$ peak shifts to high voltage values as pressure is decreased. $V_p$ can be determined from peak locations.

In order to detect light ions without using large values of applied voltage, a secondary collector may be used. Light ions may be defined as those having proton mass ratios in the range of 1 to 10. The secondary collector will be located such that ions having a small orbit radius (relative to ions which strike the primary collector) will strike it. A secondary collector 52 is depicted in FIG. 1. Ions following the path 5 pass through secondary exit ion pathway 51, which is located in secondary exit foil 50. Ion current flows to a reference location, passing through wire 53, which is routed through shield 20 in stem 15 and is measured as described above in a similar manner to the current appearing on collector 8 by electric current measuring and recording means 54. The features of the secondary collection system are the same as those described above in regard to the primary collection system. Of course, ions striking the secondary collector pass through a 180° arc inside the measuring enclosure.

Prior to fabrication of the prototype described herein, a measuring element having d=5 mm and a different exit aperture was tested. The exit aperture was located on the wall of the measuring enclosure parallel to the wall containing the entrance aperture, but lower down, near the floor of the measuring enclosure. This device provided data of poor quality.

What is claimed is:

1. A mass spectrometer apparatus comprising in combination:

a. a shield enclosure of an electrically conductive material;

b. a measuring enclosure of a magnetic material which is located inside said shield enclosure and is spaced apart from said shield enclosure by electrically insulating material;

c. an aperture in the shield enclosure and a foil which covers the shield aperture, where said shield foil has an ion pathway;

d. an entrance aperture in said measuring enclosure and an entrance foil which covers the entrance aperture, where said entrance foil has an ion pathway, and where said shield ion pathway and said entrance ion pathway are in register with one another;

e. an exit aperture in said measuring enclosure and an exit foil which covers the exit aperture, where said exit foil has an ion pathway, and where the exit aperture and said exit foil are disposed such that an axial centerline of the exit ion pathway and an axial centerline of the entrance ion pathway are located in a single plane;

f. one or more permanent magnets disposed inside the measuring enclosure to form a magnetic field, where magnetic lines of force of said magnetic field are normal to the plane of the ion pathways;

g. a collector which is disposed adjacent to said exit foil in such manner that ions passing out of the measuring enclosure through the exit ion pathway will strike said collector;

h. an electrical path from the collector to a reference location;

i. means for establishing a known applied electrical potential between said measuring enclosure and said reference location, where said applied potential has a value effective for determination of proton mass ratio of said ions which strike said collector; and j. means for measuring electric current flowing along said electrical path, where the electric current results from said ions striking said collector.

2. The apparatus of claim 1 further including means for varying the applied potential.

3. The apparatus of claim 1 further including means for varying and recording values of the applied potential and means for recording values of the electric current resulting from said ions striking the collector as said applied potential is varied.

4. The apparatus of claim 1 further including wire mesh which is disposed across the ion pathways.

5. The apparatus of claim 1 further including means for pumping on said shield enclosure and on said measuring enclosure.

6. The apparatus of claim 1 where a linear distance between said shield foil and said entrance foil is approximately equal to the orbit radius of said ions which strike the collector.

7. The apparatus of claim 1 where a linear distance between said shield foil and said entrance foil is from about 100 to about 200 plasma Debye lengths.

8. The apparatus of claim 1 further including:

a. a secondary exit aperture in said measuring enclosure and a secondary exit foil which covers said secondary exit aperture, where said secondary exit foil has an ion pathway, and where the secondary exit aperture and said secondary exit foil are disposed such that an axial centerline of the secondary exit ion pathway and the axial centerline of the entrance ion pathway are located in a single plane;

b. a secondary collector which is disposed adjacent to the secondary exit foil in such manner that ions passing out of said measuring enclosure through the secondary exit ion pathway will strike said secondary collector;

c. an electrical path from the secondary collector to said reference location; and d. means for measuring electric current flowing along said electrical path, where said electric current results from said ions striking said secondary collector.

9. A method for determining mass and quantities of ions comprising the steps of:

a. maintaining a shield enclosure at an electrical potential relative to a reference location, where said electrical potential is termed a floating potential and is established by means of placing the shield enclosure in a plasma, where the shield enclosure has a shield foil including an ion pathway, and where the difference in magnitude between plasma potential and said floating potential induces ions to enter the shield enclosure through said shield ion pathway and accelerates the entering ions;

b. providing a measuring enclosure having an entrance foil including an entrance ion pathway, where said measuring enclosure is located inside the shield enclosure and is spaced apart from the shield enclosure by electrically insulating material, and where said entrance ion pathway is in register with the shield ion pathway;

c. establishing a known applied electrical potential, termed the applied potential, between the measuring enclosure and said reference location, where said applied potential induces said ions passing through the shield ion pathway to enter the measuring enclosure through the entrance ion pathway and accelerates the entering ions;

d. providing a magnetic field in the measuring enclosure having magnetic lines of force which are normal to paths of said ions entering the measuring enclosure, where said magnetic field causes said ions which enter the measuring enclosure to travel in a non-linear orbit;

e. providing an exit ion pathway in the measuring enclosure, where an axial centerline of said exit ion pathway and an axial centerline of the entrance ion pathway are in a single plane, and where the exit ion pathway is located such that a portion of the ions entering the measuring enclosure will pass through the exit ion pathway;

f. providing a collector disposed outside the measuring enclosure in such manner that said ions passing through the exit ion pathway will strike said collector;

g. providing an electrical path from the collector to the reference location;

h. measuring electric current flow in said electrical path, where said electric current results from said ions striking the collector; and i. determining the proton mass ratio of said ions striking the collector by reference to values of the applied potential and the plasma potential.

10. The method of claim 9 where said ion proton mass ratio is determined by the equation $$\rho=0.144\,(EA/Z)^{0.5}/B,$$

$$E=V_p-V_a$$

where and A=proton mass ratio, $V_p$=plasma potential, $V_a$=applied potential,

ρ=orbit radius of the ions striking the collector,

Z=charge state of the ions striking the collector, and

B=magnetic field strength.

11. The method of claim 9 where relative numbers of particular said ions striking the collector are determined by comparing values of ion current at the applied voltage characteristic of each ion.

12. The method of claim 9 where the applied potential is varied over a range, thereby causing said ions of varying proton mass ratio to strike the collector.

13. The method of claim 9 where the applied potential is varied over a range and values of said applied potential and values of said electric current flow resulting from said ions striking the collector are simultaneously recorded.

14. The method of claim 9 where the shield enclosure and measuring enclosure are pumped.

15. The method of claim 9 where a linear distance between the shield foil and the entrance foil is about equal to the orbit radius of said ions which strike the collector.

16. The method of claim 9 where the linear distance between the shield foil and the entrance foil is from about 100 to about 200 Debye lengths.

17. The method of claim 9 where the applied voltage is varied from about plus 100 to about minus 100 volts.

18. The method of claim 9 where the measuring enclosure has a secondary exit aperture, a secondary exit foil, and a secondary collector.

* * * * *